US007942598B2

(12) United States Patent
Iwata

(10) Patent No.: US 7,942,598 B2
(45) Date of Patent: May 17, 2011

(54) WRITING IMPLEMENT

(75) Inventor: Hisashi Iwata, Aichi (JP)

(73) Assignee: The Pilot Ink Co., Ltd., Aichi (JP)

( * ) Notice: Subject to any disclaimer, the term of this patent is extended or adjusted under 35 U.S.C. 154(b) by 971 days.

(21) Appl. No.: 11/312,540

(22) Filed: Dec. 21, 2005

(65) Prior Publication Data

US 2006/0140706 A1 Jun. 29, 2006

(30) Foreign Application Priority Data

Dec. 24, 2004 (JP) ..... P.2004-374390

(51) Int. Cl.
*B43K 23/12* (2006.01)

(52) U.S. Cl. ..... 401/245; 401/247; 401/246; 401/243

(58) Field of Classification Search ..... 401/202, 401/213, 243, 245–247, 217, 201, 208, 209
See application file for complete search history.

(56) References Cited

U.S. PATENT DOCUMENTS

| | | | | | |
|---|---|---|---|---|---|
| 764,227 | A * | 7/1904 | Eberstein | 401/246 |
| 969,198 | A * | 9/1910 | Sanford | 401/246 |
| 1,307,630 | A * | 6/1919 | Haskins | 401/245 |
| 1,717,001 | A * | 6/1929 | Benson | 401/246 |
| 1,822,167 | A * | 9/1931 | Most | 401/243 |
| 1,904,014 | A * | 4/1933 | Sager | 401/236 |
| 1,978,724 | A * | 10/1934 | Sager | 401/246 |
| 2,140,554 | A * | 12/1938 | Sager | 401/246 |
| 5,000,603 | A * | 3/1991 | Isoda | 401/202 |
| 5,061,105 | A * | 10/1991 | Isoda | 401/213 |
| 5,297,883 | A * | 3/1994 | Ozu | 401/202 |
| 5,551,789 | A * | 9/1996 | Okawa et al. | 401/202 |
| 5,927,887 | A * | 7/1999 | Ishikawa et al. | 401/202 |
| 6,428,235 | B1 * | 8/2002 | Takanashi et al. | 401/202 |
| 6,890,118 | B2 * | 5/2005 | Oike | 401/202 |
| 2001/0012468 | A1 * | 8/2001 | Furukawa et al. | 401/34 |
| 2004/0028465 | A1 | 2/2004 | Furukawa et al. | |

FOREIGN PATENT DOCUMENTS

| | | | |
|---|---|---|---|
| CN | 2241633 | Y | 12/1996 |
| CN | 1413840 | A | 4/2003 |
| DE | 38-17-248 | C1 | 10/1989 |
| JP | 2-144488 | U | 12/1990 |
| JP | 2001-080283 | A | 3/2001 |

OTHER PUBLICATIONS

Korean Office Action dated Jul. 22, 2009.
Chinese Office Action dated Jul. 17, 2009.

* cited by examiner

*Primary Examiner* — David J. Walczak
*Assistant Examiner* — Keegan Gumbs
(74) *Attorney, Agent, or Firm* — Sughrue Mion, PLLC

(57) ABSTRACT

The outer surface of an inner cap 3 is fixedly secured to the inner surface of an outer cap 4. In the opened end portion of the inner cap 3, there is formed a rear end shell portion 31 which projects backwardly. On the outer peripheral surface of the rear end shell portion 31, there is provided a ring-shaped outward facing seal portion. In the front end portion of a barrel 6, there is formed a front end shell portion 61 projecting forwardly. In the inner peripheral surface of the front end shell portion 61, there is formed a ring-shaped inward facing seal portion. When a cap 2 is mounted on the pen tip 8 side of the barrel 6, the outward facing seal portion can be closely contacted with the inward facing seal portion in the radial direction.

17 Claims, 11 Drawing Sheets

WRITING IMPLEMENT

BACKGROUND OF THE INVENTION

1. Field of the Invention

The present invention relates to a writing implement. In this invention, the term [front] means a closed side of a cap and a pen tip side of the main body of the writing implement, while the term [rear] means an opened side of the cap and an ink tank side of the main body of the writing implement.

2. Description of the Background Art

Referring to a writing implement of this type, conventionally, in Japanese Utility Model Unexamined Publication No. JP-UM-A-2-144488, there is disclosed a cap mounting structure of the writing implement, in which the cap including an inner cap therein is mounted on a leading end portion of a barrel including a pen tip to thereby keep interior of the cap in air tight manner, wherein the inner cap is formed of soft elastic resin material and a ring-shaped projection is provided on the leading end face of the barrel and/or the end face portion of the inner cap which, when the cap is mounted onto the barrel, they are pressed against each other.

With use of the cap mounting structure disclosed in the above-mentioned JP-UM-A-2-144488, there is a fear that, when the cap is mounted, the pen tip can be contacted with the ring-shaped projection (airtight seal portion) on the end face of the inner cap to thereby cause ink to adhere to the ring-shaped projection and thus stain the ring-shaped projection or to thereby damage the ring-shaped projection and thus cause poor air tightness.

Especially, if the ink adheres to the ring-shaped projection, there is a fear that the ink adhered to the ring-shaped projection, as the cap is mounted onto the barrel, can adhere to the barrel and thus, when a user holds the barrel with a hand, the ink can adhere to the hand to thereby stain the hand.

Also, with use of the cap mounting structure disclosed in the JP-UM-A-2-144488, since the airtight seal portion is formed in the front end face of the barrel and the airtight seal portion is exposed to the outside, there is a fear that the airtight seal portion can be damaged by accident to thereby cause a poor airtight condition.

Further, with use of the cap mounting structure disclosed in the JP-UM-A-2-144488, in order to prevent the air in the interior of the inner cap from being compressed in the cap mounting operation, there is formed a notch in the ring-shaped projection for fixing the cap to the barrel. Thus, the cap mounting structure disclosed in the JP-UM-A-2-144488 provides a structure in which the air existing in the interior of the inner cap flows through a clearance between the outer surface of the barrel and the inner surface of the cap and is discharged to the outside from the opening end portion of the cap. However, since the clearance between the outer surface of the barrel and the inner surface of the cap cannot be set so large actually, there is a fear that, when the cap mounting operation is performed suddenly, the pressure air (compressed air) within the cap cannot be sufficiently discharged to the outside, thereby causing the pressure air to flow into the inside of the barrel; or, when a cap removing operation is carried out suddenly, the air existing within the cap can be decompressed, whereby the ink can leak out from the pen point side.

SUMMARY OF THE INVENTION

In view of the above-described problems, the invention aims at solving the problems found in the above-mentioned conventional structure. That is, it is an object of the invention to provide a writing implement in which: when mounting a cap, a pen tip can be prevented from contacting with an airtight seal portion formed in the cap to thereby not only prevent damage to the airtight seal portion of the cap and ink adhesion to the airtight seal portion but also prevent damage to an airtight seal portion formed in a barrel; even when the cap is mounted suddenly, pressurization of the air in the inside of the cap can be avoided sufficiently; and, even when the cap is removed suddenly, decompression of the air in the interior of the inner cap can be sufficiently prevented.

According to the invention, there is provided a writing implement comprising:

a cap comprising:

an inner cap having a closed front end portion and an opened rear end portion; and an outer cap fixed to an outer surface of the inner cap, at least a rear end of the outer cap being opened; and a writing implement main body for mounting the cap removably thereon, and including a barrel having a pen tip on a front end portion, wherein, when the cap is mounted on the pen tip side of the barrel, the inner cap seals the pen tip and an inner surface of the outer cap is fitted with an outer surface of the barrel, characterized in that:

a backwardly projecting rear end shell portion is formed in the opened rear end portion of the inner cap, a ring-shaped outward facing seal portion is formed in an outer peripheral surface of the rear end shell portion, a forwardly projecting front end shell portion is formed in the front end portion of the barrel, a ring-shaped inward facing seal portion is formed in an inner peripheral surface of the front end shell portion, and when the cap is mounted onto the pen tip side of the barrel, the outward facing seal portion closely contacts with the inward facing seal portion in a radial direction.

According to a second aspect of the present invention, there is provided a writing implement, comprising:

a cap comprising:

an inner cap having a closed front end portion and an opened rear end portion; and an outer cap fixed to an outer surface of the inner cap, at least a rear end of the outer cap being opened; and a writing implement main body for mounting the cap removably thereon, and including a barrel having a pen tip on a front end portion, wherein, when the cap is mounted on the pen tip side of the barrel, the inner cap seals the pen tip and an inner surface of the outer cap is fitted with an outer surface of the barrel, characterized in that:

a backwardly projecting rear end shell portion is formed in the opened end portion of the inner cap, a ring-shaped outward facing seal portion is formed in an outer peripheral surface of the rear end shell portion, a forwardly projecting front end shell portion is formed in the front end portion of the barrel, a ring-shaped inward facing seal portion is formed in an inner peripheral surface of the front end shell portion, when the cap is mounted onto the pen tip side of the barrel, the outward facing seal portion closely contacts with the inward facing seal portion in the radial direction, a ventilating hole is formed in a side wall or a top wall of the outer cap so as to penetrate therethrough, and when the outward facing seal portion and the inward facing seal portion are not in close contact with each other, an interior of the inner cap and an the exterior of the outer cap are allowed to communicate with each other through the ventilating hole.

According to a third aspect of the present invention, there is provided a writing implement, comprising:

a cap comprising:

an inner cap having a closed front end portion and an opened rear end portion; and an outer cap fixed to an outer surface of the inner cap, having a closed front end portion and an opened rear end portion; and a writing implement main body for mounting the cap removably thereon, and including a barrel having a pen tip on a front end thereof, wherein when the cap is mounted on the pen tip side of the barrel, the inner cap seals the pen tip and an inner surface of the outer cap is fitted with an outer surface of the barrel, characterized in that:

a backwardly projecting rear end shell portion is formed in the opened end portion of the inner cap, a ring-shaped outward facing seal portion is formed in an outer peripheral surface of the rear end shell portion, a forwardly projecting front end shell portion is formed in the front end portion of the barrel, a ring-shaped inward facing seal portion is formed in an inner peripheral surface of the front end shell portion, when the cap is mounted onto the pen tip side of the barrel, the outward facing seal portion closely contacts with the inward facing seal portion in a radial direction, a ventilating hole is formed in a side wall or a top wall of the outer cap so as to penetrate therethrough, and when the outward facing seal portion and the inward facing seal portion are not in close contact with each other, an interior of the inner cap and an exterior of the outer cap are allowed to communicate with each other through the ventilating hole.

According to a fourth aspect of the present invention, it is preferable that the ventilating hole is formed in the side wall of the outer cap at a position of outside of the rear end shell portion of the inner cap in the radial direction, or in the side wall or the top wall of the outer cap existing forwardly of the rear end shell portion of the inner cap so as to penetrate therethrough.

According to a fifth aspect of the present invention, it is preferable that a restrict wall portion, with which the front end of the front end shell portion of the barrel contacts, is formed in the outer surface of the inner cap existing forwardly of the outward facing seal portion.

According to a sixth aspect of the present invention, it is preferable that a restrict wall portion, with which the rear end of the rear end shell portion of the inner cap contacts, is formed in the inner surface of the barrel existing backwardly of the inward facing seal portion.

According to a seventh aspect of the present invention, it is preferable that a axial-direction close contact sliding length between the outward facing portion and the inward facing portion is set in a range of 0.1 mm to 1.0 mm.

According to an eighth aspect of the present invention, the writing implement main body comprises:

an ink storing member having the pen tip at a front end thereof, the barrel accommodating the ink storing member in the front portion thereof, and an ink tank formed backwardly of the ink storing member within the barrel, wherein the ink storing member stores provisionally surplus ink corresponding to an increase in internal pressure of the ink tank.

According to a ninth aspect of the present invention, a portion of the rear end shell portion existing backwardly of the restrict wall portion is formed thin in thickness and cylindrical in shape.

According to a tenth aspect of the present invention, the portion of the front end shell portion existing forwardly of the restrict wall portion is formed thin in thickness and cylindrical in shape.

According to an eleventh aspect of the present invention, a total opening areas of the ventilating hole is 0.5 $mm^2$ or more.

According to a writing implement as set forth in the first aspect of the present invention, in mounting the cap, the pen tip can be prevented from coming into contact with the airtight seal portion of the cap, which not only can prevent damage to the airtight seal portion of the cap and adhesion of ink to the airtight seal portion but also can prevent damage to the airtight seal portion of the barrel.

According to a writing implement as set forth in the second aspect of the present invention, in mounting the cap, the pen tip can be prevented from coming into contact with the airtight seal portion of the cap, which not only can prevent damage to the airtight seal portion of the cap and adhesion of ink to the airtight seal portion but also can prevent damage to the airtight seal portion of the barrel. Also, even when the cap mounting operation is carried out suddenly, pressurization of the air existing in the inside of the cap can be avoided sufficiently and, at the same time, even when the cap is removed suddenly, the decompression of the air in the inside of the cap can be prevented sufficiently.

According to a writing implement as set forth in the third aspect of the present invention, in mounting the cap, the pen tip can be prevented from coming into contact with the airtight seal portion of the cap, which not only can prevent damage to the airtight seal portion of the cap and adhesion of ink to the airtight seal portion but also can prevent damage to the airtight seal portion of the barrel. Also, even when the cap mounting operation is carried out suddenly, pressurization of the air existing in the inside of the cap can be avoided sufficiently and, at the same time, even when the cap removing operation is performed suddenly, the decompression of the air in the inside of the cap can be prevented sufficiently.

According to a writing implement as set forth in the fourth aspect of the present invention, even when the cap mounting operation is carried out suddenly, pressurization of the air existing in the inside of the cap can be avoided further sufficiently and, even when the cap removing operation is performed suddenly, the decompression of the air in the inside of the cap can be prevented further sufficiently.

According to a writing implement as set forth in the fifth aspect of the present invention, the axial-direction moving length (that is, close contact sliding length) from the start of close contact between the outward and inward facing seal portions to the end of such close contact can be kept constant.

According to a writing implement as set forth in the sixth aspect of the present invention, the axial-direction moving length (that is, close contact sliding length) from the start of close contact between the outward and inward facing seal portions to the end of such close contact can be kept constant.

According to a writing implement as set forth in the seventh aspect of the present invention, there can be obtained sufficient sealing performance between the outward and inward facing portions, in the cap mounting operation, pressurization of the air existing in the inner cap can be avoided sufficiently, and, in the cap removing operation, decompression of the air in the inner cap can be prevented sufficiently.

According to a writing implement as set forth in the eighth aspect of the present invention, there can be obtained a direct liquid type writing implement having the effects that can be provided in the above-mentioned the first through seventh aspect of the present invention.

According to a writing implement as set forth in the ninth aspect of the present invention, not only the elastic deformation of the rear end shell portion in the radial direction can be made easy but also smooth close contact sliding motions between the outward facing portion on the outer peripheral surface of the rear end shell portion and the inward facing portion on the inner peripheral surface of the front end shell portion are possible.

According to a writing implement as set forth in the tenth aspect of the present invention, not only the elastic deformation of the front end shell portion in the radial direction can be made easy but also smooth close contact sliding motions between the outward facing portion on the outer peripheral surface of the rear end shell portion and the inward facing portion on the inner peripheral surface of the front end shell portion are possible.

According to a writing implement as set forth in the eleventh aspect of the present invention, even when the cap mounting and removing operations are carried out suddenly, there can be obtained sufficient ventilating performance, thereby being able to positively prevent the inside of the cap against pressurization and decompression.

DETAILED DESCRIPTION OF THE PREFERRED EMBODIMENTS

Figure 1:
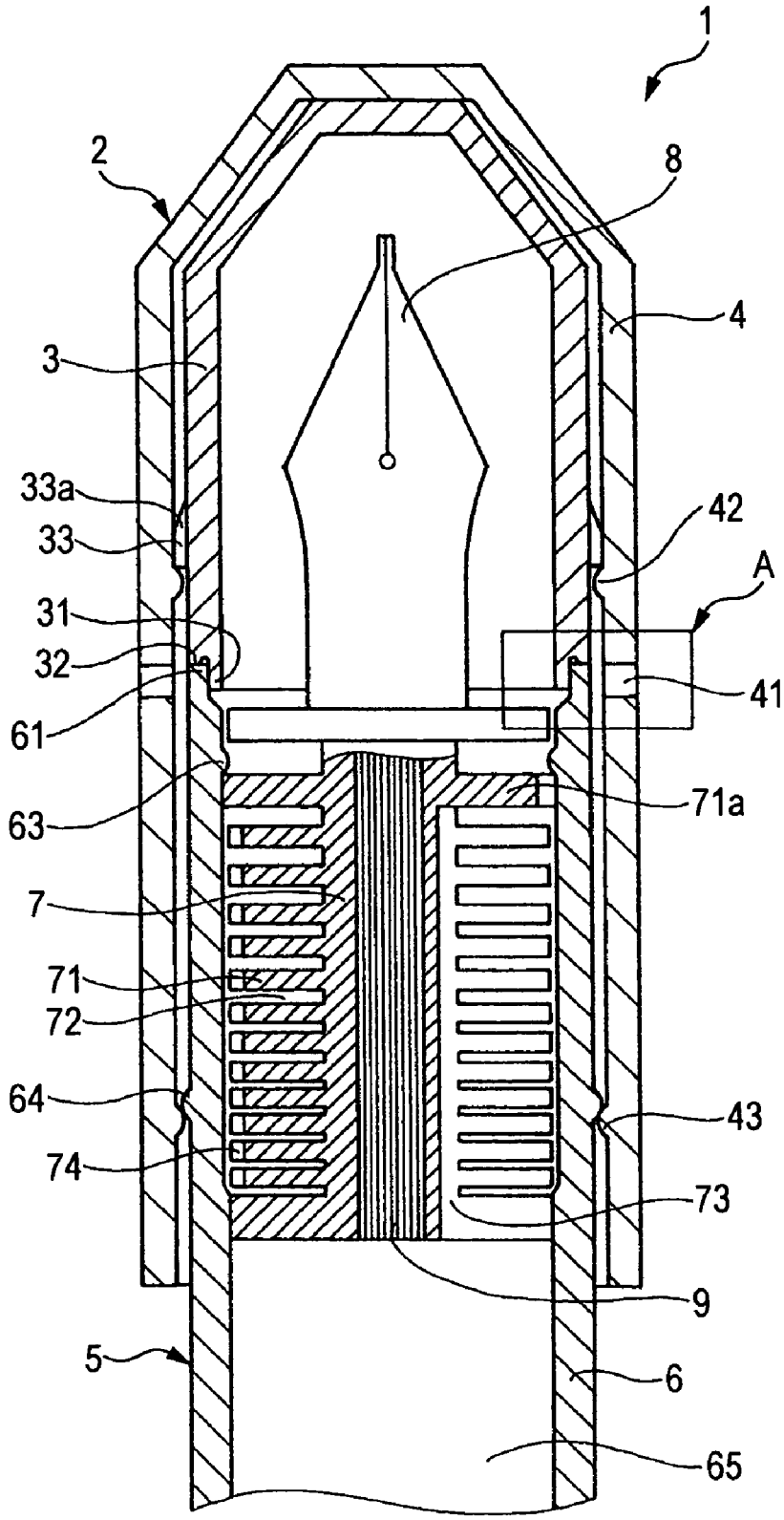
FIG. 1 is a longitudinal sectional view of the main portions of a writing implement according to a first embodiment of the invention, showing a cap mounting state thereof.

Now, description will be given below of the best mode for carrying out the invention.

According to the first aspect of the present invention, there is provided a writing implement which includes: a cap 2 including an inner cap 3 having a closed front end portion and an opened rear end portion, and an outer cap 4 fixed to an outer surface of the inner cap 3 and having at least its rear end opened; and, a writing implement main body 5 on which the cap 2 can be removably mounted, the writing implement main body 5 including a barrel 6 having a pen tip 8 in a front end portion thereof, when the cap 2 is mounted on the pen tip 8 side of the barrel 6, the inner cap 3 seals the pen tip 8, and the inner surface of the outer cap 4 and the outer surface of the barrel 6 are fitted with each other, a rear end shell portion 31 is formed in the opened rear end portion of the inner cap 3 so as to project backward, and a ring-shaped outward facing seal portion 31*a* is formed on the outer peripheral surface of the rear end shell portion 31, a front end shell portion 61 is formed in the front end portion of the barrel 6 so as to project forward, and a ring-shaped inward facing seal portion 61*a* is formed on the inner peripheral surface of the front end shell portion 61, whereby, when the cap 2 is mounted on the pen tip 8 side of the barrel 6, the outward facing seal portion 31*a* and inward facing seal portion 61*a* are closely contacted with each other in the radial direction of the writing implement.

According to the above-mentioned writing implement 1 of the first aspect of the present invention, since the ring-shaped outward facing seal portion 31*a* is formed on the outer peripheral surface of the rear end shell portion 31, when mounting the cap, the pen tip 8 can be prevented from being contacted with the outward facing seal portion 31. This makes it possible to prevent ink from adhering to the outward facing seal portion 31*a* and also prevent damage to the outward facing seal portion 31*a*. Also, according to the present writing implement 1 of the first aspect of the present invention, because the ring-shaped inward facing seal portion 61*a* is formed on the inner peripheral surface of the front end shell portion 61 and thus the inward facing seal portion 61*a* is not exposed to the outside, it is possible to avoid a trouble that the inward facing seal portion 61*a* can be damaged by mistake. As a result of this a proper close contact between the outward facing seal portion 31*a* and inward facing seal portion 61*a* is possible, thereby eliminating a fear that a poor airtight condition can occur.

Also, according to the second aspect of the present invention, there is provided a writing implement which includes: a cap 2 including an inner cap 3 having a closed front end portion and an opened rear end portion, and an outer cap 4 fixed to the outer surface of the inner cap 3 and having at least its rear end opened; and, a writing implement main body 5 on which the cap 2 can be removably mounted, the writing implement main body including a barrel 6 having a pen tip 8 in the front end thereof, when the cap 2 is mounted on the pen tip 8 side of the barrel 6, the inner cap 3 seals the pen tip 8, and the inner surface of the outer cap 4 and the outer surface of the barrel 6 are fitted with each other, a backwardly projecting rear end shell portion 31 is formed in the open end portion of the inner cap 3, a ring-shaped outward facing seal portion 31*a* is formed on the outer peripheral surface of the rear end shell portion 31, and a ventilating hole 41 is formed in the side wall or top wall of the outer cap so as to penetrate therethrough, a forwardly projecting front end shell portion 61 is formed in the front end portion of the barrel 6, and a ring-shaped inward facing seal portion 61*a* is formed on the inner peripheral surface of the front end shell portion 61, whereby when the cap 2 is mounted on the pen tip 8 side of the barrel 6, the outward facing seal portion 31*a* and inward facing seal portion 61*a* are closely contacted with each other in the radial direction of the writing implement and, when the outward facing seal portion 31*a* and inward facing seal portion 61*a* are not in close contact with each other in the radial direction of the writing implement, the interior of the inner cap 3 and the exterior of the outer cap 4 are allowed to communicate with each other through the ventilating hole 41.

According to the writing implement 1 of the second aspect of the present invention, the ring-shaped outward facing seal portion 31*a* is formed on the outer peripheral surface of the rear end shell portion 31. Thanks to this, when mounting the cap, the pen tip 8 can be prevented from being contacted with the outward facing seal portion 31. This makes it possible to prevent ink from adhering to the outward facing seal portion 31*a* and prevent the outward facing seal portion 31*a* against damage. Also, according to the present writing implement 1 of the second aspect of the present invention, because the ring-shaped inward facing seal portion 61*a* is formed on the inner peripheral surface of the front end shell portion 61 and thus the inward facing seal portion 61*a* is not exposed to the outside, it is possible to avoid a trouble that the inward facing seal portion 61*a* can be damaged by mistake. As a result of this, proper close contact between the outward facing seal portion 31*a* and inward facing seal portion 61*a* is possible thereby eliminating a fear that a poor airtight condition can occur.

Further, in the writing implement 1 of the second aspect of the present invention, the ventilating hole 41 is formed in the side wall or top wall of the outer cap 4 so as to penetrate therethrough and, when the outward facing seal portion 31*a* and inward facing seal portion 61*a* are not in close contact with each other, the interior of the inner cap 3 is in communication with the outside (the open air) of the outer cap 4 through the ventilating hole 41. Thanks to this, even when the cap is mounted suddenly, the air in the interior of the inner cap 3 can be discharged through the ventilating hole 41 to the exterior of the outer cap 4, which can sufficiently prevent the air of the interior of the inner cap 3 from being pressurized; and, even when the cap is removed suddenly, it is sufficiently possible to prevent the air of the interior of the inner cap 3 from being decompressed. This can eliminate a fear that ink can leak to the outside from the pen tip side.

Also, according to the third aspect of the present invention, there is provided a writing implement which includes: a cap 2 including an inner cap 3 having a closed front end portion and an opened rear end portion, and an outer cap 4 integrally connected to the outer surface of the inner cap 3 having a closed front end portion and an opened rear end portion; and, a writing implement main body 5 on which the cap 2 can be removably mounted, the writing implement main body 5 including a barrel 6 having a pen tip 8 in the front end thereof, wherein, when the cap 2 is mounted on the pen tip 8 side of the barrel 6, the inner cap 3 seals the pen tip 8, and the inner surface of the outer cap 4 and the outer surface of the barrel 6 are fitted with each other, a backwardly projecting rear end shell portion 31 is formed in the open end portion of the inner cap 3, a ring-shaped outward facing seal portion 31*a* is formed on the outer peripheral surface of the rear end shell portion 31, and a ventilating hole 41 is formed in the side wall or top wall of the outer cap 4 so as to penetrate therethrough, a forwardly projecting front end shell portion 61 is formed in the front end portion of the barrel 6, and a ring-shaped inward facing seal portion 61*a* is formed on the inner peripheral surface of the front end shell portion 61, whereby, when the cap 2 is mounted on the pen tip 8 side of the barrel 6, the outward facing seal portion 31*a* and inward facing seal portion 61*a* are closely contacted with each other in the radial direction of the writing instrument and, when the outward facing seal portion 31*a* and inward facing seal portion 61*a* are not closely contacted with each other, the interior of the inner cap 3 and the exterior of the outer cap 4 are allowed to communicate with each other through the ventilating hole 41.

In the above writing implement 1 of the third aspect of the present invention, since the ring-shaped outward facing seal portion 31*a* is formed on the outer peripheral surface of the rear end shell portion 31, when mounting the cap, the pen tip 8 can be prevented from coming into contact with the outward facing seal portion 31*a*. This not only can prevent ink from adhering to the outward facing seal portion 31*a* but also can prevent the outward facing seal portion 31*a* against damage. Also, according to the present writing implement 1 of the third aspect of the present invention, because the ring-shaped inward facing seal portion 61*a* is formed on the inner peripheral surface of the front end shell portion 61 and thus the inward facing seal portion 61*a* is not exposed to the outside, the inward facing portion 61*a* can be prevented from being damaged by mistake. This can realize proper close contact between the outward facing seal portion 31*a* and inward facing seal portion 61*a*, thereby eliminating a fear of occurrence of a poor seal condition.

Further, according to the writing implement 1 of the third aspect of the present invention, the ventilating hole 41 is opened up in the side wall or top wall of the outer cap 4 so as to penetrate therethrough and, when the outward facing seal portion 31*a* and inward facing seal portion 61*a* are not in close contact with each other, the interior of the inner cap 3 and the outside (the open air) of the outer cap 4 are allowed to communicate with each other through the ventilating hole 42. Owing to this, even when the cap is mounted suddenly, the air of the interior of the inner cap 3 can be discharged to the exterior of the outer cap 4 through the ventilating hole 41 to thereby be able to sufficiently prevent the air of the interior of the inner cap 3 from being pressurized; and, even when the cap is removed suddenly, the pressure of the air of the interior of the inner cap 3 can be sufficiently prevented against decompression. This eliminates a fear of the ink leaking to the outside from the pen tip side.

And, according to the fourth aspect of the present invention, there is provided a writing implement 1 in which the above-mentioned ventilating hole 41 is opened up in the side wall of the outer cap 4 at a position of outside in the radial direction of the rear end shell portion 31 of the inner cap 3 so as to penetrate therethrough, or in the side wall or top wall of the outer cap 4 at a position more forwardly than the rear end shell portion 31 of the inner cap 3 so as to penetrate therethrough.

In the present writing implement 1 of the fourth aspect of the present invention, when the cap is mounted suddenly, the interior of the inner cap 3 is in communication with the open air through the ventilating hole 41 until just before the outward facing seal portion 31*a* of the inner cap 3 is closely contacted with the inward facing seal portion 61*a* of the barrel 6. Because of this, even when the cap is mounted suddenly, the pressurization of the air of the interior of the inner cap 3 can be avoided further sufficiently. Also, according the writing implement 1 of the fourth aspect of the present invention, when the cap is removed suddenly, immediately when the close contact between the outward facing seal portion 31*a* and inward facing seal portion 61*a* is removed, the interior of the inner cap 3 and the open air are allowed to communicate with each other through the ventilating hole 41. Thanks to this, even when the cap is removed suddenly, a reduction in the pressure of the air of the interior of the inner cap 3 can be avoided sufficiently. By the way, to penetratingly form the ventilating hole 41 in the side wall of the outer cap 4 radially at a position of outside of the rear end shell portion 31 of the inner cap 3 means that: the ventilating hole 41 is situated in the neighborhood of the opened end portion of the inner cap 3, or the positions of the ventilating hole 41 and rear end shell portion 31 in the axial direction are substantially coincident with each other.

If the ventilating hole 41 is positioned greatly distant in the backward direction from the rear end shell portion 31 of the inner cap 3, there is a fear that, when the cap is mounted suddenly, the air of the interior of the inner cap 3 can be pressurized before the outward facing seal portion 31*a* of the inner cap 3 is closely contacted with the inward facing seal portion 61*a* of the barrel 6 and the-thus pressurized air can be charged into the barrel 6. Similarly, if the ventilating hole 41 is positioned greatly distant in the backward direction from the rear end shell portion 31 of the inner cap 3, there is a fear that, when the cap is removed suddenly, even if the close contact between the outward facing seal portion 31*a* of the inner cap 3 and the inward facing seal portion 61*a* of the barrel 6 is removed, the air of the interior of the inner cap 3 can be decompressed in the process where the writing implement main body 5 is completely removed from the cap.

And, according to the fifth aspect of the present invention, there is provided a writing implement in which in the outer surface of the inner cap 3 existing forwardly of the outward facing seal portion 31, there is formed a restrict wall portion 32 with which the front end of the front end shell portion 61 of the barrel 6 can be contacted (see FIGS. 1 to 5, 8 and 9). This structure makes it possible to keep constant the axial-direction moving length (that is, close-contact sliding length L) of the outward facing seal portion 31*a* and inward facing seal portion 61*a* from the start of their mutual close contact to the end of such close contact.

Also, according to the sixth aspect of the present invention, there is provided a writing implement in which in the inner surface of the barrel 6 existing backwardly of the inward facing seal portion 61*a*, there is formed a restrict wall portion 62 with which the rear end of the rear end shell portion 31 of the inner cap 3 can be contacted (see FIGS. 6, 7, 10 and 11). This structure makes it possible to keep constant the axial-direction moving length (that is, close-contact sliding length L) of the outward facing seal portion 31*a* and inward facing seal portion 61*a* from the start of their mutual close contact to the end of such close contact.

According to the seventh aspect of the present invention, there is provided a writing implement in which the axial-direction close-contact sliding length L of the outward facing seal portion 31*a* and inward facing seal portion 61*a* is set in the range of 0.1 mm to 1.0 mm (preferably, 0.1 mm to 0.5 mm). Thanks to this structure, there can be obtained sufficient sealing performance between the outward facing seal portion 31*a* and inward facing seal portion 61*a*. Also, when mounting the cap, pressurization of the air in the interior of the inner cap 3 can be avoided sufficiently and, when removing the cap, decompression of the air of the interior of the inner cap can be avoided sufficiently.

If the close-contact sliding length L is smaller than 0.1 mm, there is a fear that sufficient sealing performance cannot be obtained between the outward facing seal portion 31*a* and inward facing seal portion 61*a* and thus the sealing of the pen tip 8 can be made imperfect. On the other hand, if the close-contact sliding length L is larger than 1.0 mm, there is a fear that, in the normal cap mounting operation, the air in the inner cap 3 can be pressurized and the—thus pressurized air can be charged into an ink tank, or, in the normal cap removing operation, the air in the inner cap 3 can be decompressed.

Also, according to the eighth aspect of the present invention, there is provided a writing implement in which the above-mentioned writing implement main body 5 includes an ink storing member 7 having a pen tip 8 in the front end thereof, a barrel 6 storing the ink storing member 7 in the front portion thereof, and an ink tank 65 formed within the barrel 6 in the rear of the ink storing member 7, while the ink storing member 7 provisionally stores surplus ink corresponding to a rise in the internal pressure of the ink tank 65. This structure can provide a writing implement of a direct liquid type in which, adhesion of the ink to the outward facing seal portion 31*a* and thus damage of the outward facing seal portion 31*a* can be avoided, proper close contact is possible between the outward facing seal portion 31*a* and inward facing seal portion 61*a*, and thus there is no fear of occurrence of a poor airtight condition. Further, this structure can provide a writing implement of a direct liquid type in which, even when the cap is mounted suddenly or even when the cap is removed suddenly, there is no fear of ink leaking from the pen tip side to the outside.

Also, in a writing implement according to the ninth aspect of the present invention, the portion of the rear end shell portion 31 existing in the rear of the restrict wall portion 32 is formed thin in thickness and cylindrical in shape. This structure not only can facilitate the elastic deformation of the rear end shell portion 31 in the radial direction thereof but also can realize smooth close-contact sliding motion between the outward facing seal portion 31*a* formed on the outer peripheral surface of the rear end shell portion 31 and the inward facing seal portion 61*a* on the inner peripheral surface of the front end shell portion 61. By the way, the expression "the rear end shell portion 31 is thin in thickness" means that the rear end shell portion 31 is thin in thickness when compared with the portion of inner cap 3 existing forwardly of the rear end shell portion 31.

Also, in writing implement according to the tenth aspect of the present invention, the portion of the front end shell portion 61 existing forwardly of the restrict wall portion 62 is formed thin in thickness and cylindrical in shape. This structure not only can facilitate the elastic deformation of the front end shell portion 61 in the radial direction thereof but also can realize smooth close-contact sliding motion between the outward facing seal portion 31*a* formed on the outer peripheral surface of the rear end shell portion 31 and the inward facing seal portion 61*a* on the inner peripheral surface of the front end shell portion 61. By the way, the expression "the front end shell portion 61 is thin in thickness" means that the front end shell portion 61 is thin in thickness when compared with the portion of the barrel 6 existing forwardly of the front end shell portion 61.

Also, in writing implement according to the eleventh aspect of the present invention, the total opening area of the above-mentioned ventilating hole is 0.5 $mm^2$ or more (preferably, 1 $mm^2$ or more, more preferably, 3 $mm^2$ or more) Also, the total opening area of the above-mentioned ventilating hole is 200 $mm^2$ or less (preferably, 100 $mm^2$ or less, more preferably, 50 $mm^2$ or less). According to this structure, even when the mounting and removing operation of the cap is carried out suddenly, not only there can be obtained sufficient ventilation performance but also pressurization and depressurization of the air in the cap can be prevented positively. If the total opening area of the ventilating hole is less than 0.5 $mm^2$ (square millimeters), when the cap mounting and removing operation is executed suddenly, the ventilation performance is insufficient, thereby raising a fear that the air in the inside of the cap can be pressurized or depressurized. By the way, the expression "the total opening area of the ventilating hole 41" means that, when the ventilating hole 41 is composed of two or more ventilating holes, the sum total of the opening areas of the ventilating holes 41.

EMBODIMENTS

Now, description will be given below in order of the embodiments of a writing implement 1 according to the invention with reference to the accompanying drawings.

First Embodiment

Figure 2:
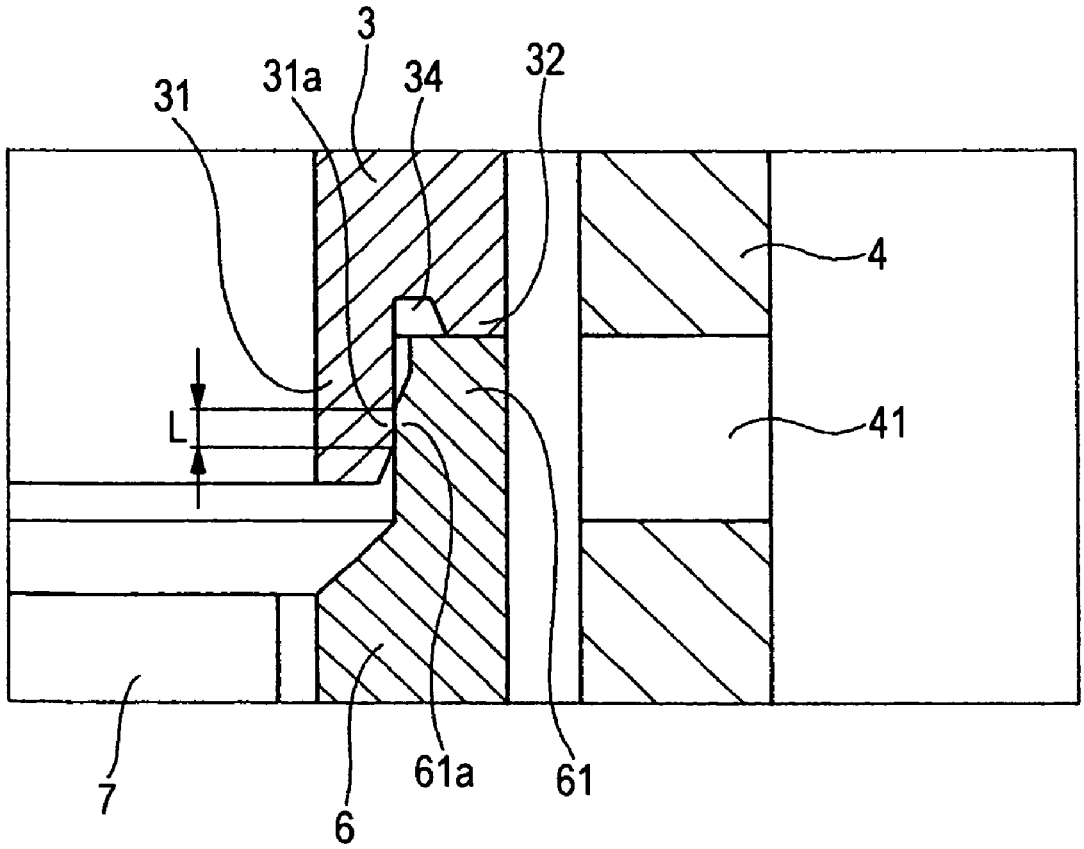
FIG. 2 is an enlarged view of the A portion shown in FIG. 1.
Figure 3:
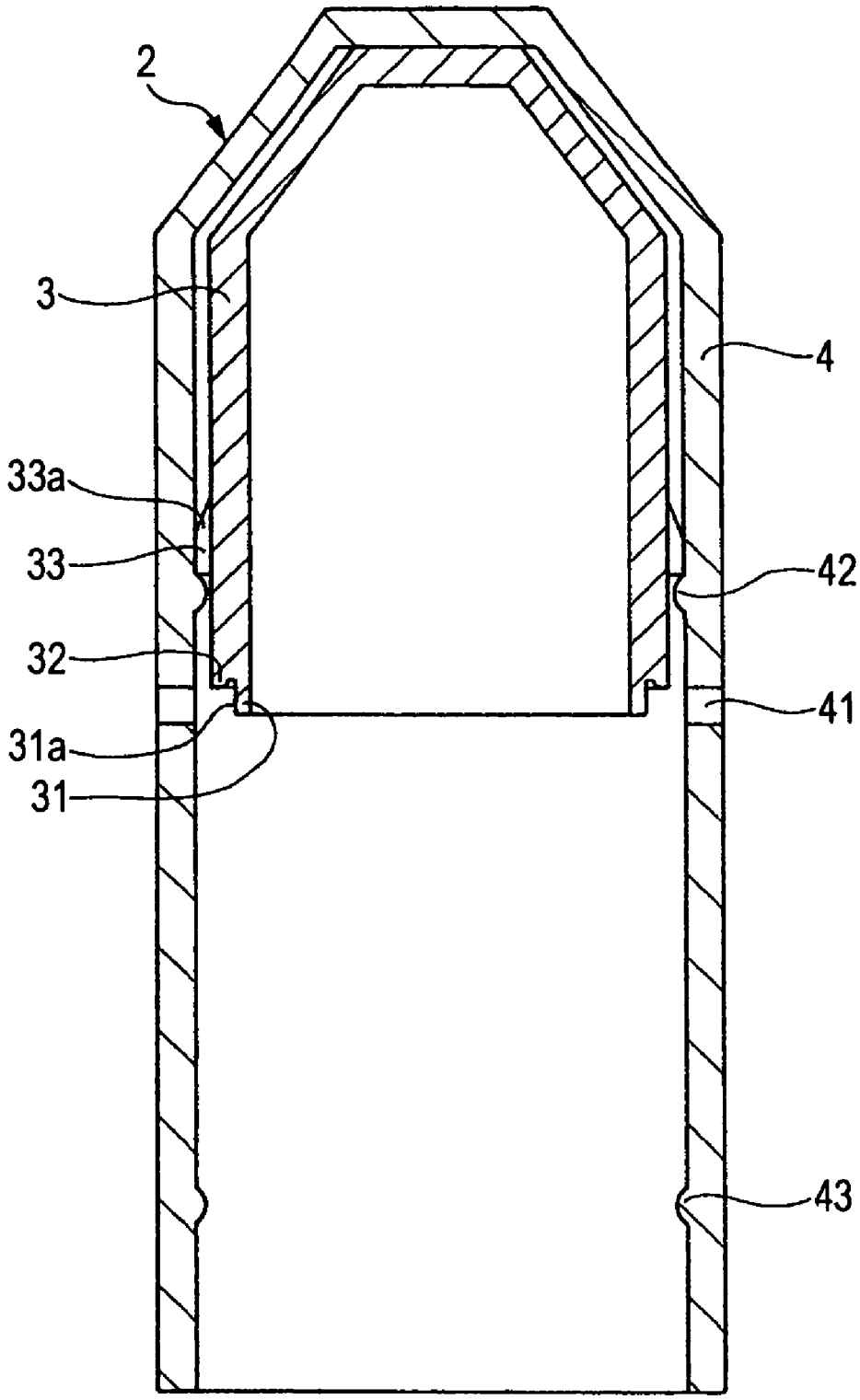
FIG. 3 is a longitudinal sectional view of a cap shown in FIG. 1.
Figure 4:
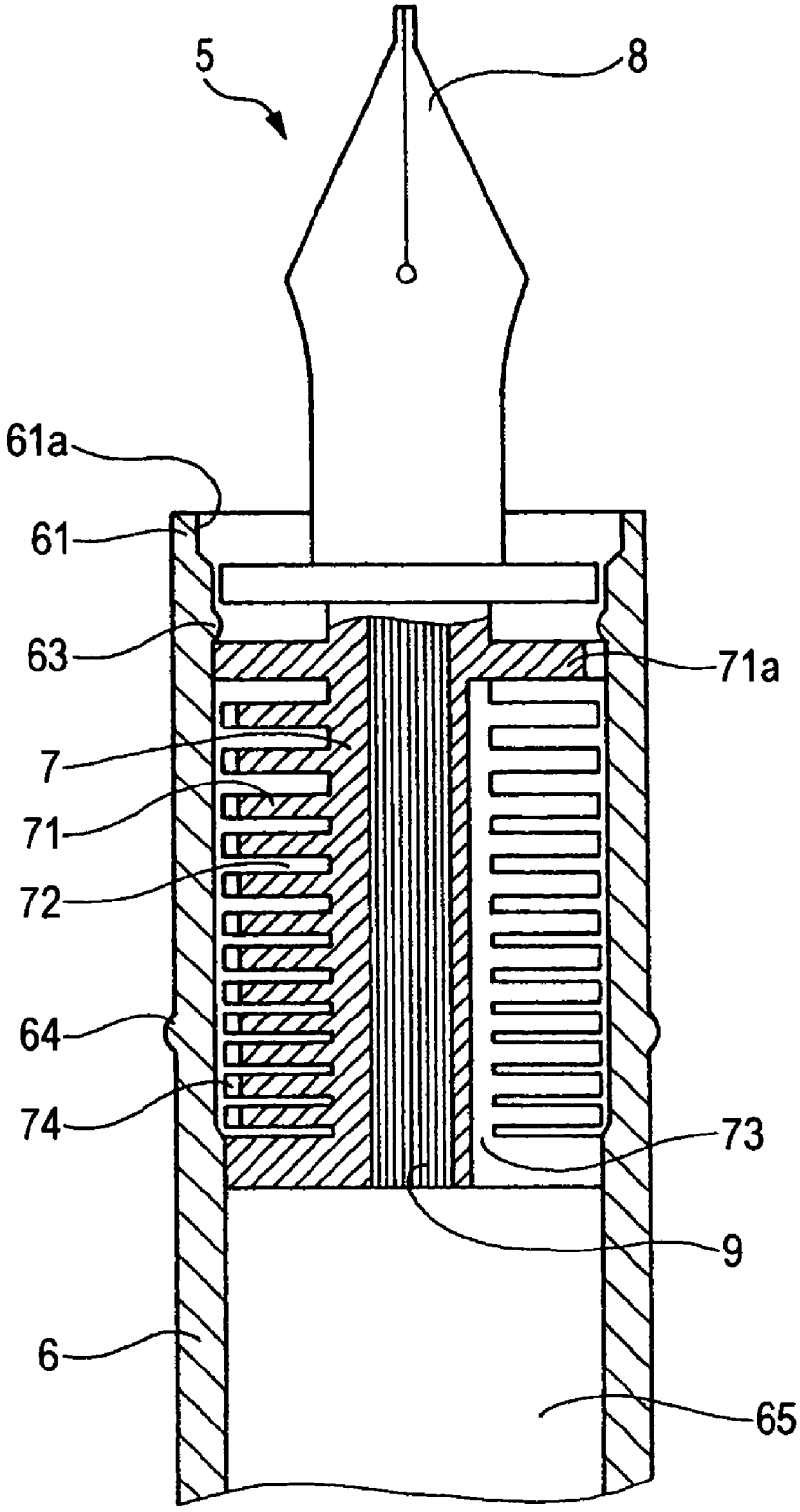
FIG. 4 is a longitudinal sectional view of a writing implement main body shown in FIG. 1.

FIGS. 1 to 4 show a first embodiment of a writing implement 1 according to the invention. Specifically, FIG. 1 shows a state of the writing implement 1 according to the first embodiment in which a cap is mounted. FIG. 2 is an enlarged view of the A portion of FIG. 1. FIG. 3 shows a cap 2 shown in FIG. 1. FIG. 4 shows the pen tip 8 side of a writing implement main body 5 shown in FIG. 1. The present embodiment comprises a cap 2 and a writing implement main body 5 structured such that the cap 2 can be removably mounted on the pen tip 8 side thereof.

(Cap)

Now, description will be given below of the cap 2 according to the present embodiment. The cap 2 comprises an inner cap 3 and an outer cap 4 with the inner cap 3 fixed to the inner surface thereof, the outer cap 4 being made of other part than the inner cap 3.

(Inner Cap)

The inner cap 3 is formed as a cylindrical-shaped bottomed shell member with its front end closed and its rear end opened. That is, the inner cap 3 has the closed front end portion and the opened rear end portion. The inner cap 3 can be produced by injection molding synthetic resin (for example, polypropylene). In the present embodiment, the inner cap 3 is made of transparent synthetic resin; however, it may also be made of opaque synthetic resin.

On the outer peripheral surface of the inner cap 3, there is provided an outward facing projection 33 which is formed in a ring shape and is formed integral with the inner cap 3. In the projection 33, there is opened up a ventilating groove 33*a* which extends in the axial direction of the inner cap 3 and penetrates through the outward facing projection 33. The ventilating groove 33*a*, specifically, consists of two ventilating grooves arranged at symmetrical positions with respect to the axis of the inner cap 3.

In the opened end portion of the inner cap 3, there is integrally formed a rear end shell portion 31 which is cylindrical in shape and is thin in thickness. On the outer peripheral surface of the rear end shell portion 31, there is integrally formed a ring-shaped outward facing seal portion 31*a*. This outward facing seal portion 31*a* may include a ring-shaped smooth surface or a ring-shaped projection and, in the present embodiment, the ring-shaped smooth surface is employed. In the outer peripheral surface of the inner cap 3 existing forwardly of the outward facing seal portion 31*a* (that is, the outer peripheral surface of the base portion of the rear end shell portion 31), there is integrally formed a step-shaped restrict wall portion 32. That is, the rear end shell portion 31 existing backwardly of the restrict wall portion 32 is formed such that it is thin in thickness and is cylindrical in shape.

Also, in a portion existing inwardly of the restrict wall portion 32 in the radial direction thereof (that is, a portion where the rear end shell portion 31 and restrict wall portion 32 are connected with each other), there is formed a ring-shaped recessed portion 34. Thanks to this, even if burrs project from the front end inner peripheral edge of the front end shell portion 61 of the barrel 6 after molded, when mounting the cap, the burrs can be stored into the ring-shaped recessed portion 34 to thereby prevent the burrs from coming into contact with the outer surface of the inner cap 3, so that the restrict wall portion 32 and the front end of the front end shell portion 61 can be properly contacted with each other.

(Outer Cap)

The outer cap 4 includes a cylindrical-shaped bottomed shell member with the closed front end and the opened rear end. The outer cap 4 can be obtained by injection molding synthetic resin (for example, polycarbonate). On the inner peripheral surface of the outer cap 4, there is provided a ring-shaped inward facing projection 42 integrally therewith. In the present embodiment, the outer cap 4 is formed of transparent synthetic resin; however, it may also be formed of opaque synthetic resin.

When fixedly securing the inner cap 3 to the inside of the outer cap 4, the inner cap 3 is inserted into the outer cap 4, the inward facing projection 42 of the outer cap 4 is moved over and fitted with the outward facing projection 33 of the inner cap 3 and, simultaneously with this, the outer surface of the top wall of the inner cap 3 is contacted with the inner surface of the top wall of the outer cap 4 in the backward and forward direction. Owing to this, the outer surface of the inner cap 3 and the inner surface of the outer cap 4 are fixedly secured to each other without wobbling in the backward and forward direction. Also, the ventilating groove 33*a* of the outward facing projection 33 on the outer surface of the inner cap 3 defines a clearance between the inner cap 3 outer surface and outer cap 4 inner surface which allows the air to flow in the backward and forward direction.

In the side wall of the outer cap 4, there is opened up a ventilating hole 41 in such a manner that it penetrates through the outer cap 4 side wall in the radial direction. The ventilating hole 41 is situated outwardly in the radial direction of the rear end shell portion 31 (that is, in the vicinity of the opening end of the inner cap 3). The size and number of the ventilating hole 41 are set properly so as to be able to secure a sufficient air flow passage. In the present embodiment, the ventilating hole 41 is composed of two ventilating holes which are positioned symmetrical with respect to the axis of the outer cap 4. Also, the shape of the ventilating hole 41 maybe circular, elliptical, polygonal, or the like. And, in the present embodiment, since there are opened up two ventilating holes each having an opening area of 1.77 $mm^2$, the total opening area of the ventilating hole 41 is set for 3.54 $mm^2$. That is, the total opening area of the ventilating hole 41 is more than 0.5 $mm^2$. Because of this, even the cap mounting or removing operation is carried out suddenly, there can be obtained sufficient ventilating performance, which can positively prevent the air in the cap against pressurization or depressurization.

Also, on the inner surface of the outer cap 4 existing in the rear of the ventilating hole 41, there is provided a projection for fitting 43 integrally therewith. The fitting projection 43 on the inner surface of the outer cap 4, when mounting the cap, is moved over and fitted with a fitting projection 64 which is provided on the outer surface of the barrel 6. The fitting projection 43 and fitting projection 64 may be preferably structured such that one of them is formed as a ring-shaped projection and the other is composed of two or more dot-shaped projections dispersed in a circuit. Owing to this, even when the cap mounting or removing operation is carried out suddenly, there can be formed an air passage between the fitting projection 43 and fitting projection 64, which makes it possible to further prevent the air between the outer cap 4 inner surface and barrel 6 outer surface from being pressurized or depressurized. Here, this structure is not limitative but the fitting projection 43 and fitting projection 64 may also be structured such that both are formed as ring-shaped projections.

(Writing Implement Main Body)

Next, description will be given below of the writing implement main body 5 according to the present embodiment. The writing implement main body 5 according to the present embodiment includes a cylindrical-shaped barrel 6 with opened front end, an ink storing member 7 composed of two or more comb teeth 71 to be fitted into the inner surface of the front end opening portion of the barrel 6, a pen tip 8 to be held on the front end of the ink storing member 7, and an ink guide core 9 to be connected to the pen tip 8 and inserted into the axial hole of the ink storing member 7.

The barrel 6 can be obtained by injection molding synthetic resin (for example, polypropylene). In the rear of the ink storing member 7 within the barrel 6, there is disposed an ink tank 65 for storing ink directly therein; and, the ink tank 65 may be formed integrally with the barrel 6 or may be composed of a cartridge vessel which can be removably mounted on the barrel 6. In the opening end portion of the barrel 6, there is formed a cylindrical-shaped thin front end shell portion 61 integrally therewith. On the inner peripheral surface of the front end shell portion 61, there is provided a ring-shaped inward facing seal portion 61*a* integrally therewith. The inward facing seal portion 61*a* may be formed of a ring-shaped smooth surface or a ring-shaped projection. In the present embodiment, there is employed a ring-shaped smooth surface.

On the inner peripheral surface of the barrel 6 existing in the rear of the front end shell portion 61 (inward facing seal portion 61*a*), there is provided a ring-shaped removal preventive projection 63 integrally therewith. The removal preventive projection 63 can be moved over and fitted with a supporting tomb tooth 71*a* having a larger outside diameter than the remaining comb teeth 71 of the ink storing member 7, so that the projection 63 can prevent the ink storing member 7 against removal. Since the opening end portion of the barrel 6 existing in front of the removal preventive projection 63 is not in contact with the ink storing member 7, the fitting of the ink storing member 7 into the barrel 6 has no influence on the inside diameter dimension of the inward facing seal portion 61*a*.

The ink storing member 7 can be obtained by injection molding synthetic resin (for example, ABS resin). The ink storing member 7 is a member which provisionally stores ink overflowing in correspondence to an increase in the pressure within the ink tank 65. The ink storing member 7 comprises two or more disk-shaped comb teeth 71, an ink store groove 72 formed between the comb teeth 71, an ink guide slit 73 formed in the comb teeth 71 so as to penetrate through them in the axial direction thereof, and a notch-shaped air groove 74 formed in each of the comb teeth 71. Also, in the axial center of the ink storing member 7, there is formed an axial center hole so as to penetrate therethrough; and, into the axial center hole, there can be inserted the ink guide core 9 (for example, a synthetic resin extrusion mold body or a fiber bundle resin work body). And, on the front end portion of the ink storing member 7, there is mounted the pen tip 8 (for example, the pen tip of a fountain pen made of a metal-plate bent work body having a slit in the front end thereof). The front end of the ink guide core 9 is connected to the pen tip 8, whereas the rear end of the ink guide core 9 is connected to the inside of the ink tank 65.

Operation of the Present Embodiment

According to the present embodiment, when the cap 2 is mounted on the pen tip 8 side of the writing implement main body 5, as shown in FIGS. 1 and 2, the outward facing seal portion 31*a* of the inner cap 3 is closely contacted with (that is, airtight fitted with) the inward facing seal portion 61*a* of the barrel 6 in the radial direction, the front end of the front end shell portion 61 of the barrel 6 is contacted with the restrict wall portion 32 of the inner cap 3 in the axial direction, and, further, the fitting projection 43 on the inner surface of the outer cap 4 is moved over and fitted with the fitting projection 64 on the outer surface of the barrel 6.

Also, in the cap mounting process, until just before the outward facing seal portion 31*a* is closely contacted with the inward facing seal portion 61*a*, the interior of the inner cap 3 is in sufficient communication with the open air through the ventilating hole 41. Thanks to this, even if the cap is mounted suddenly, pressurization of the air in the interior of the inner cap 3 can be avoided sufficiently. Also, in the cap removing process, immediately when the close contact between the outward facing seal portion 31*a* and inward facing seal portion 61*a* is removed, the interior of the inner cap 3 comes into communication with the open air through the ventilating hole 41. Because of this, even if the cap is removed suddenly, depressurization of the air in the interior of the inner cap 3 can be avoided sufficiently.

Also, according to the present embodiment, the pen tip 8 can be prevented from coming into contact with the outward facing seal portion 31*a* (airtight seal portion) within the cap 2 in the cap mounting operation, which can avoid damage to the outward facing seal portion 31*a* as well as ink adhesion to the outward facing seal portion 31*a*; and also, since the inward facing seal portion 61*a* (airtight seal portion) of the barrel 6 is not exposed to the outside, the cap can be prevented from touching the inward facing seal portion 61*a* by mistake, thereby being able to prevent damage to the inward facing seal portion 61*a*.

The axial-direction close contact sliding length L between the outward facing seal portion 31*a* and inward facing seal portion 61*a* (that is, the axial-direction close contact sliding length L from the start of close contact between the outward facing seal portion 31*a* and inward facing seal portion 61*a* to the end of such close contact) may preferably be in the range of 0.1 mm to 1.0 mm (more preferably, 0.1 mm to 0.5 mm). This can provide sufficient seal performance between the outward facing seal portion 31*a* and inward facing seal portion 61*a*, can sufficiently prevent the air in the inner cap 3 from being pressurized in the cap mounting operation, and can sufficiently prevent the air in the inner cap 3 from being depressurized in the cap removing operation.

When the close contact sliding length L is smaller than 0.1 mm, there is a fear that sufficient seal performance cannot be obtained between the outward facing seal portion 31*a* and inward facing seal portion 61*a*, thereby making imperfect the sealing condition of the pen tip 8. On the other hand, when the close contact sliding length L is larger than 1.00 mm, there is a fear that: in the cap mounting operation, the air in the inner cap 3 can be pressurized and the thus-pressurized air can be charged into the ink tank 65; and, when removing the cap, the air in the inner cap 3 can be depressurized. By the way, in the present embodiment, the close contact sliding length L is set for 0.3 mm.

Second Embodiment

Figure 5:
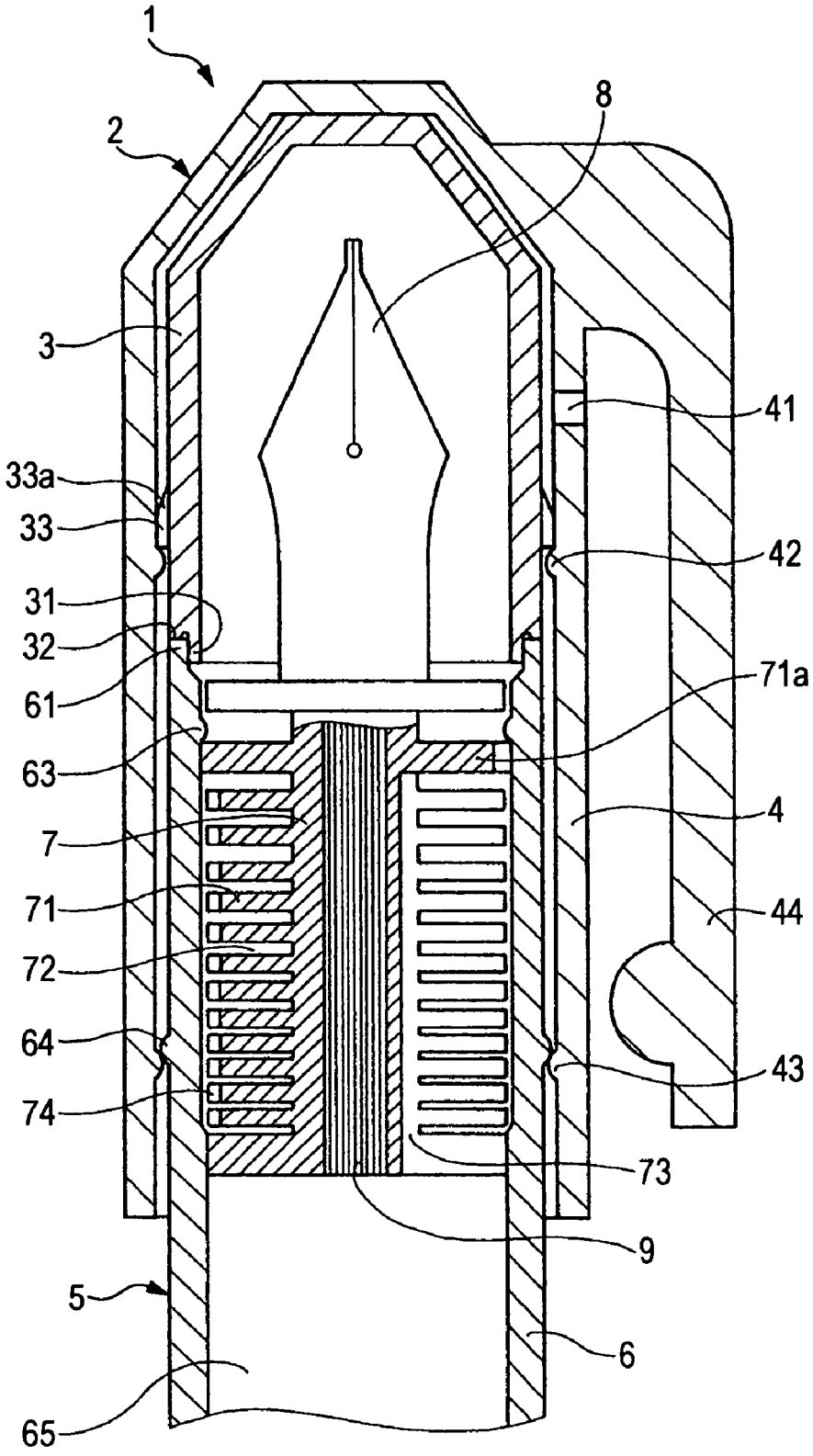
FIG. 5 is a longitudinal sectional view of the main portions of a writing implement according to a second embodiment of the invention, showing a cap mounting state thereof.

Now, FIG. 5 shows a second embodiment according to the invention.

In the second embodiment, the ventilating hole 41 is formed in the side wall of the outer cap 4 existing in front of the rear end shell portion 31 of the inner cap 3. Thanks to the ventilating hole 41, the interior of the inner cap 3 and the outside (open air) of the outer cap 4 are allowed to communicate with each other through a clearance and a ventilating groove 33*a* respectively formed between the outer surface of the inner cap 3 and the inner surface of the outer cap 4. Also, according to the second embodiment, on the outer surface of the outer cap 4, there is provided a clip 44, while the ventilating hole 41 is opened inwardly in the radial direction of the clip 44. This makes it difficult to see the ventilating hole 41 from the outside, thereby being able to enhance the outer appearance of the writing implement. By the way, the remaining structures and operations of the second embodiment are similar to those of the first embodiment and thus the description thereof is omitted here.

Third Embodiment

Figure 6:
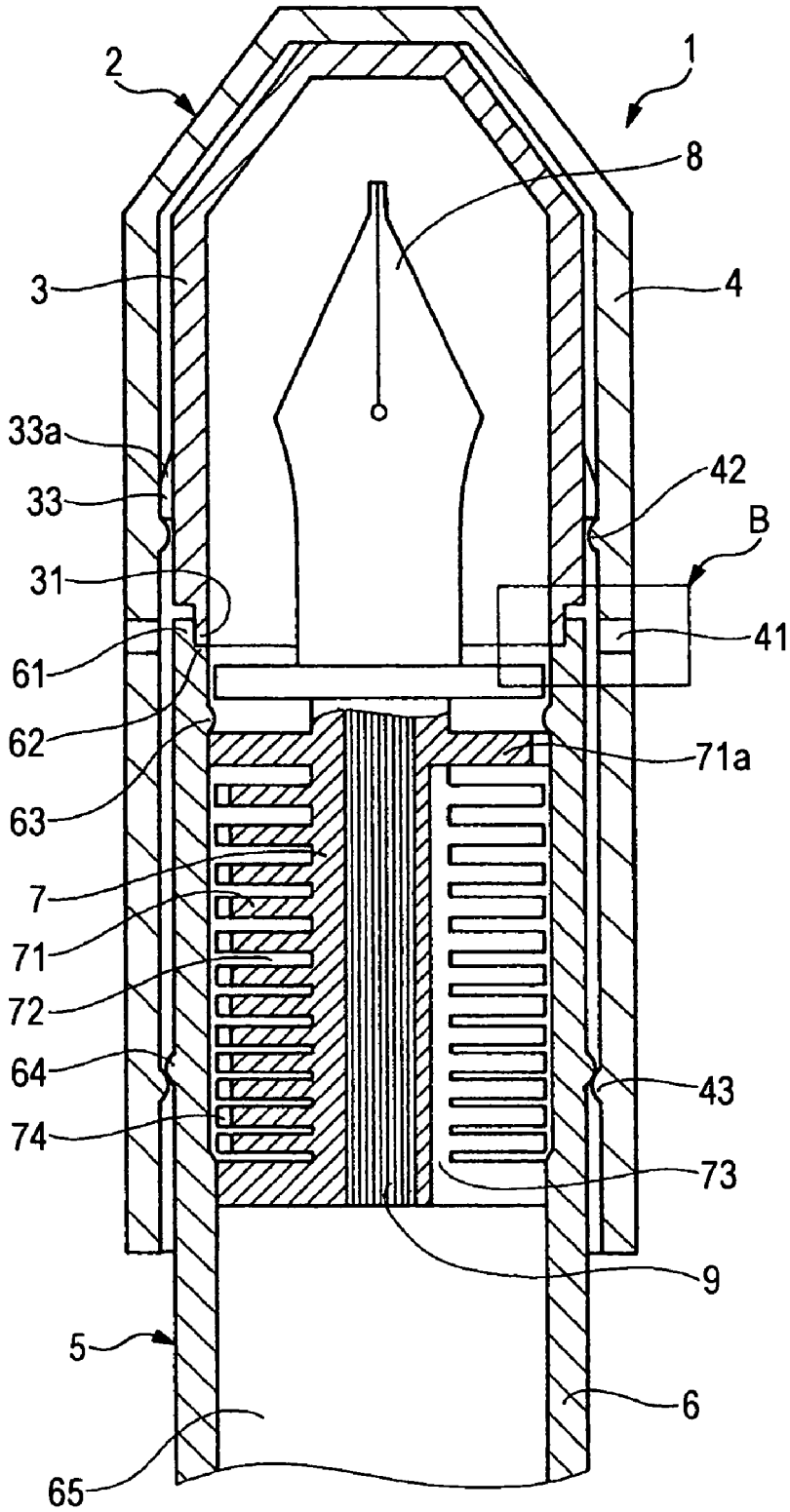
FIG. 6 is a longitudinal sectional view of the main portions of a writing implement according to a third embodiment of the invention, showing a cap mounting state thereof.
Figure 7:
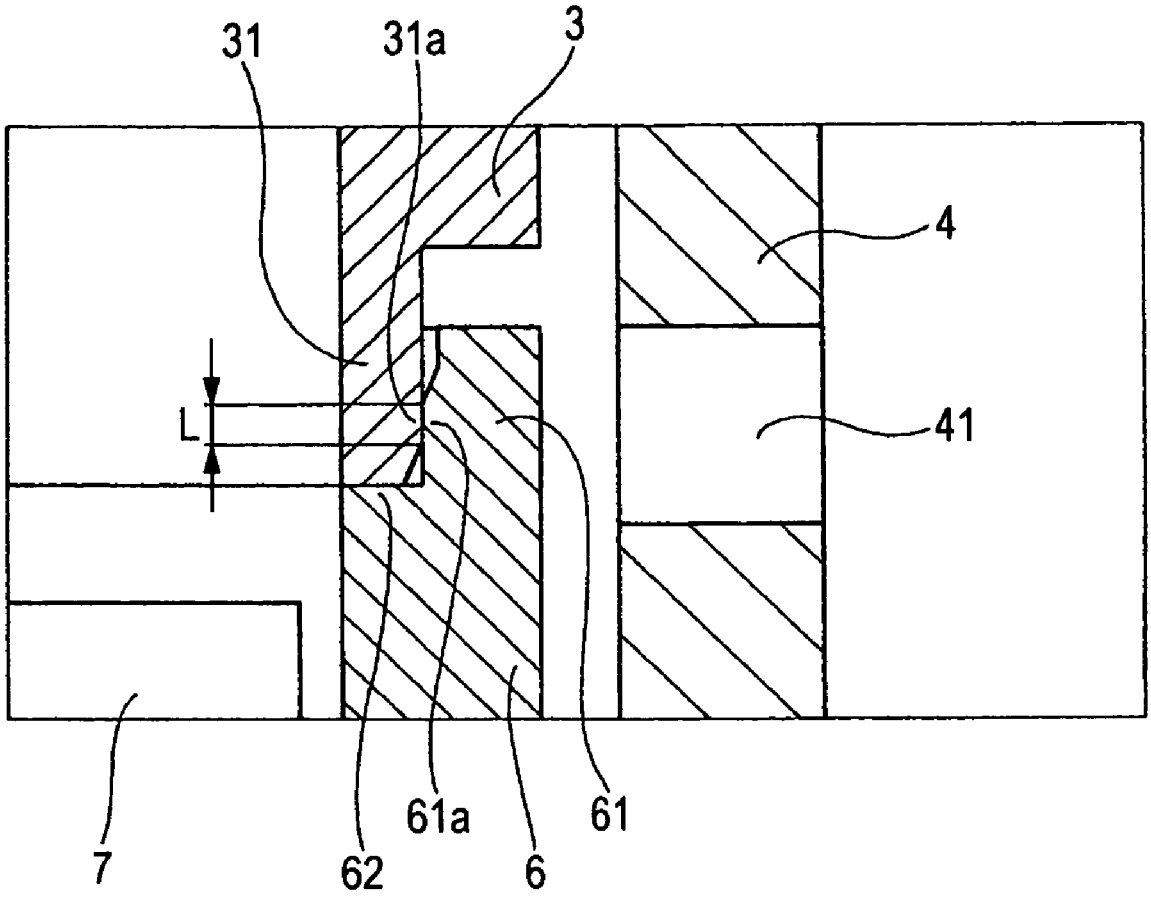
FIG. 7 is an enlarged view of the B portion shown in FIG. 6.

Now, FIGS. 6 and 7 show a third embodiment according to the invention.

According to the third embodiment, on the inner surface of the barrel 6 existing backwardly of the inward facing seal portion 61*a* of the front end shell portion 61, there is provided a step-shaped restrict wall portion 62 integrally therewith. In the cap mounting operation, simultaneously when the outward facing seal portion 31*a* of the inner cap 3 is closely contacted with the inward facing seal portion 61*a* of the barrel 6 in the radial direction, the rear end of the rear end shell portion 31 of the inner cap 3 is contacted with the restrict wall portion 62 in the axial direction. The portion of the front end shell portion 61 existing forwardly of the restrict wall portion 62 is formed in a thin cylindrical shape. By the way, the remaining structures and operations of the third embodiment are similar to those of the first embodiment and thus the description thereof is omitted here.

Fourth Embodiment

Figure 8:
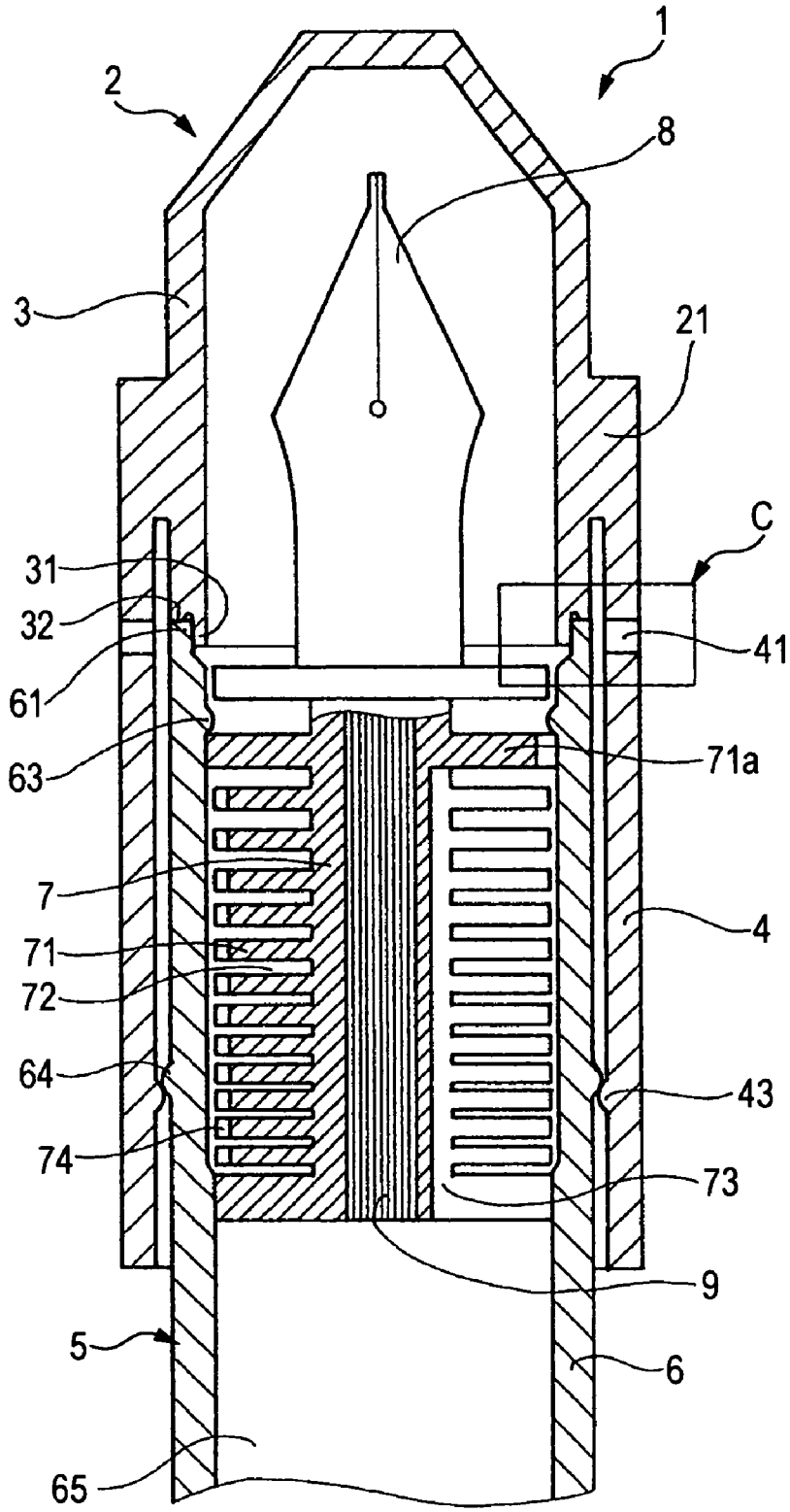
FIG. 8 is a longitudinal sectional view of the main portions of a writing implement according to a fourth embodiment of the invention, showing a cap mounting state thereof.
Figure 9:
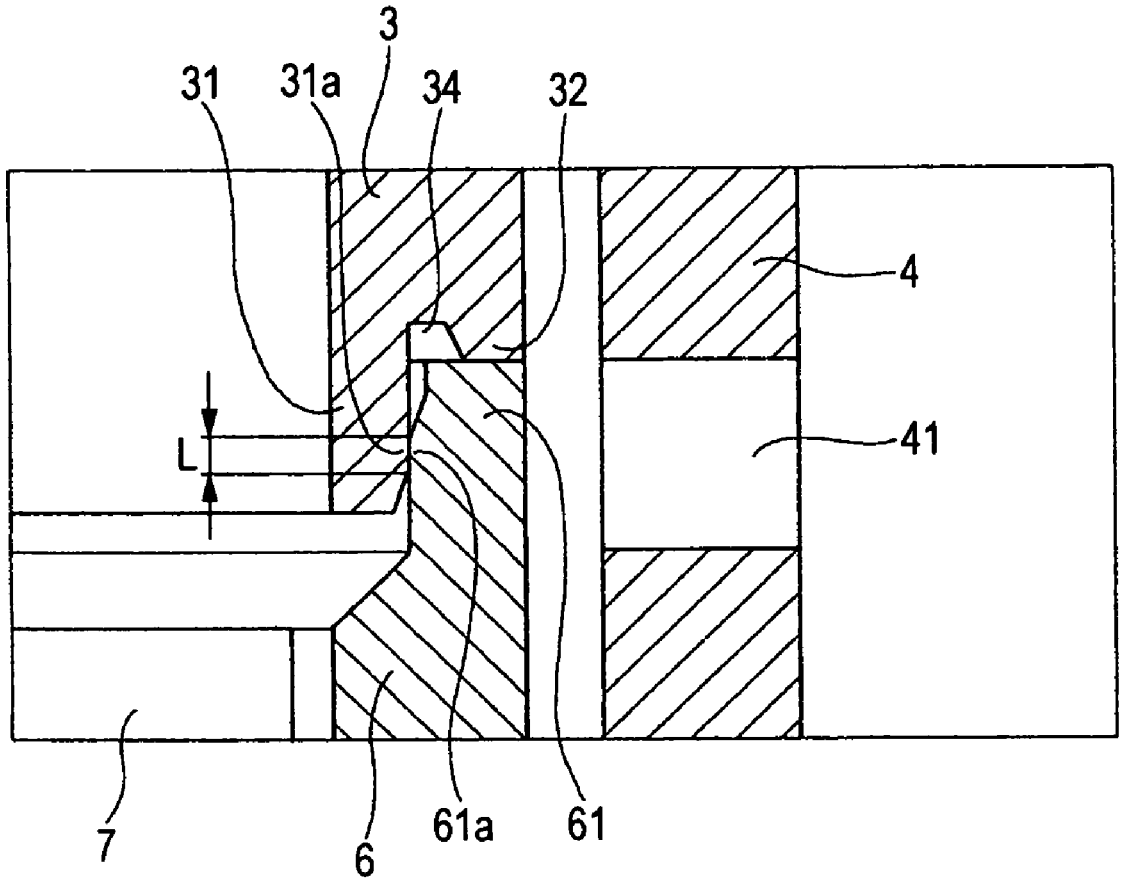
FIG. 9 is an enlarged view of the C portion shown in FIG. 8.

Now, FIGS. 8 and 9 show a fourth embodiment according to the invention.

According to the fourth embodiment, the cap 2 is produced by injection molding synthetic resin (for example, polypropylene), while the outer surface of the inner cap 3 and the inner surface of the outer cap 4 are integrally connected to each other through a ring-shaped connecting wall portion 21. The inner cap 4 and outer cap 4 are respectively made of a cylindrical-shaped bottomed shell body with its front end closed and its rear end opened. In other words, in the fourth embodiment, the cap 2 is composed of a single part; whereas, in the before-described first, second and third embodiments, the cap 2 is composed of two pars, that is, the inner cap 3 and outer cap 4. By the way, the remaining structures and operations of the fourth embodiment are similar to those of the first embodiment and thus the description thereof is omitted here.

Fifth Embodiment

Figure 10:
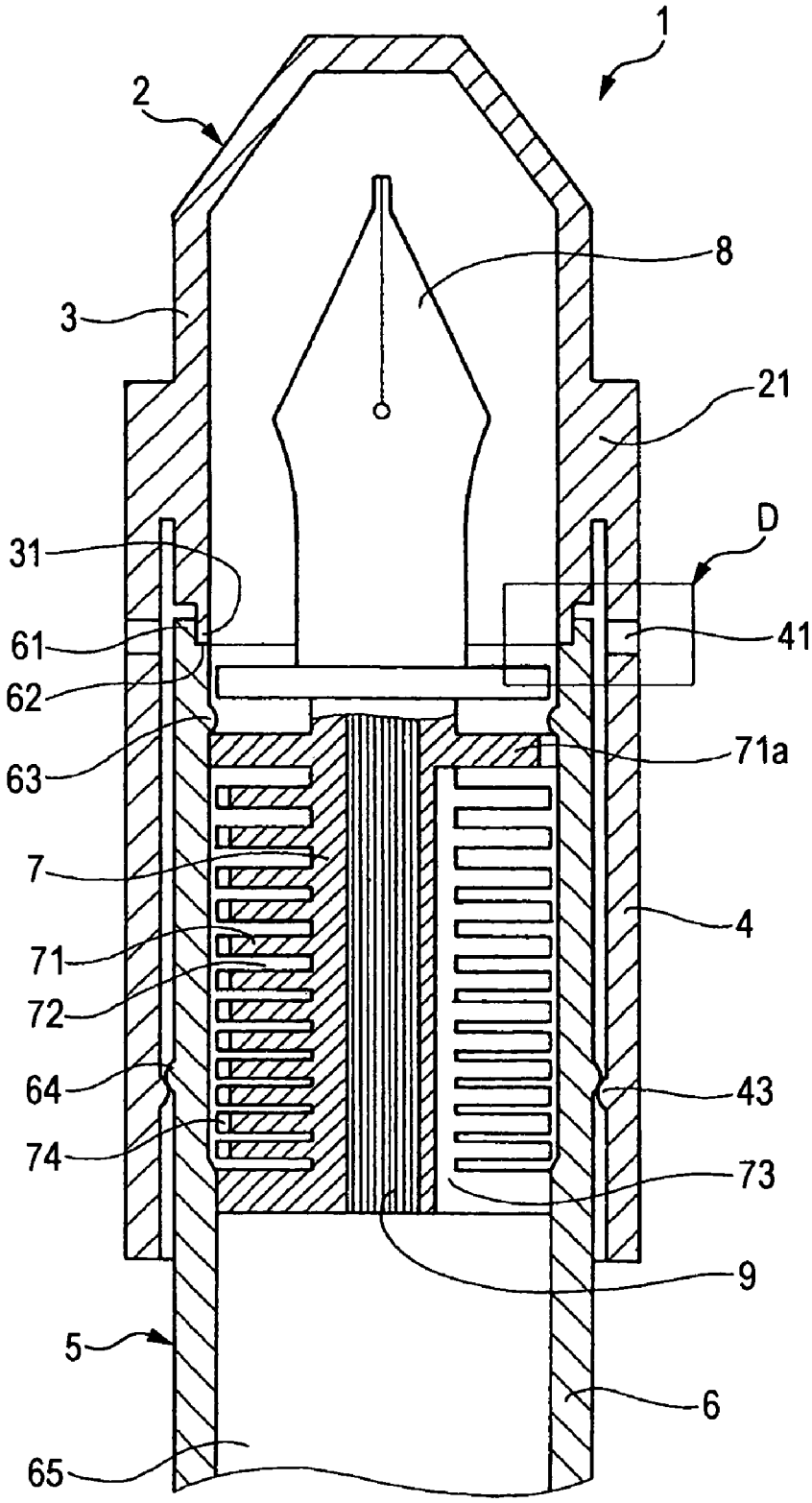
FIG. 10 is a longitudinal sectional view of the main portions of a writing implement according to a fifth embodiment of the invention, showing a cap mounting state thereof.
Figure 11:
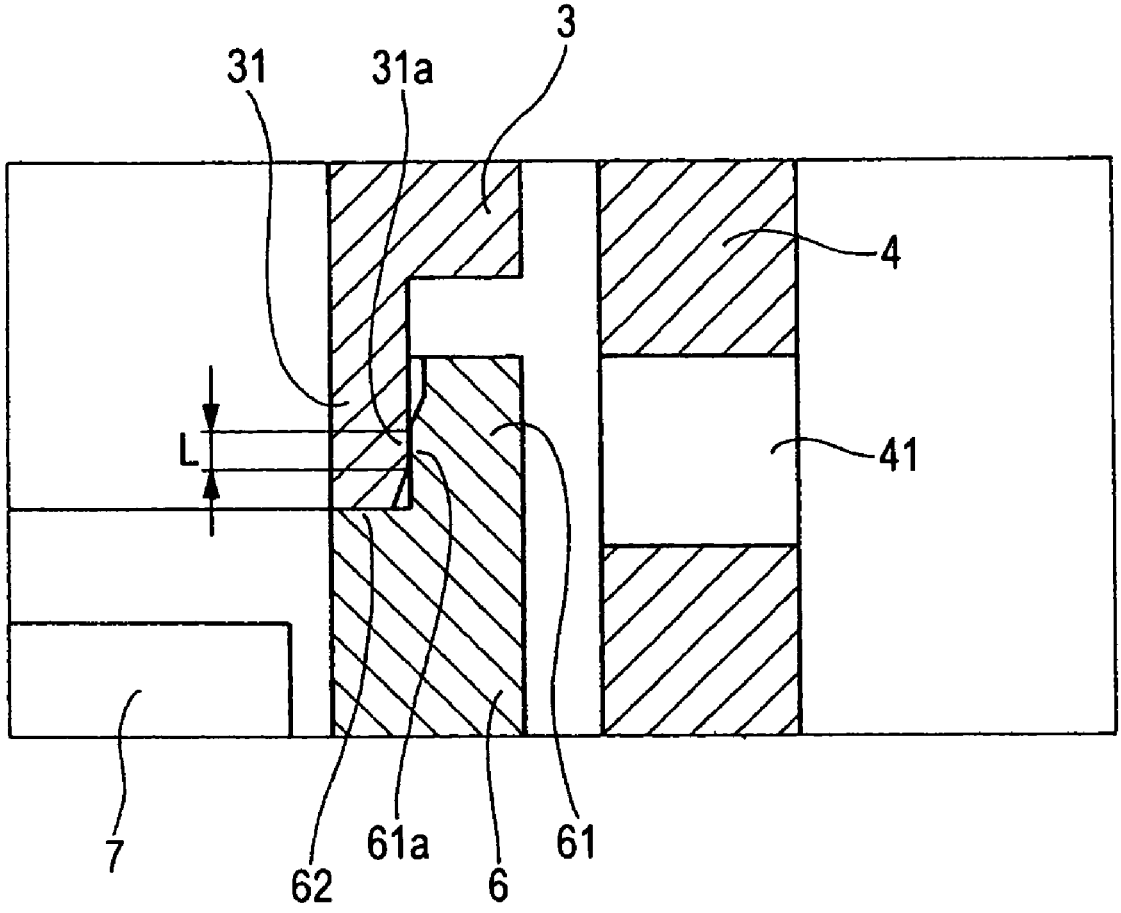
FIG. 11 is an enlarged view of the D portion shown in FIG. 10.

Now, FIGS. 10 and 11 show a fifth embodiment according to the invention.

According to the fifth embodiment, similarly to the fourth embodiment, the cap 2 is produced by injection molding synthetic resin (for example, polypropylene), while the outer surface of the inner cap 3 and the inner surface of the outer cap 4 are integrally connected to each other through a ring-shaped connecting wall portion 21. The inner cap 4 and outer cap 4 are respectively made of a cylindrical-shaped bottomed shell body with its front end closed and its rear end opened. According to the fifth embodiment, similarly to the third embodiment, in the inner surface of the barrel 6 existing backwardly of the inward facing seal portion 61*a* of the front end shell portion 61, there is provided a step-shaped restrict wall portion 62 integrally therewith. In the cap mounting operation, simultaneously when the outward facing seal portion 31*a* of the inner cap 3 is closely contacted with the inward facing seal portion 61*a* of the barrel 6 in the radial direction, the rear end of the rear end shell portion 31 of the inner cap 3 is contacted with the restrict wall portion 62 in the axial direction. By the way, the remaining structures and operations of the fifth embodiment are similar to those of the first and third embodiments and thus the description thereof is omitted here.

By the way, according to the invention, the term "barrel 6" includes a pen tip holder which holds the pen tip 8 and is mounted on the front end opening of the barrel 6. And, according to the invention, the pen tip 8 is not limited to the above-mentioned embodiments and thus may also include any one of a ball-point pen point, a fiber pen body, a porous pen body, a plastic pen body formed by synthetic resin extrusion molding, a brush pen body and the like. Also, according to the invention, the writing implement main body 5 is not limited to a direct liquid type structure disclosed in the above-mentioned embodiments in which ink is stored directly in the inside of the barrel 6, but it may also employ a structure (of a so called indirect type) in which ink is impregnated into and held by an ink occlusion body made of a fiber work body or the like. Further, according to the invention, the outer cap 4 is not limited to the outer cap disclosed in the above-mentioned embodiments which is structured such that one of the two ends thereof is closed, but it may also be structured such that its two ends are opened. In addition, in the first, third, fourth and fifth embodiments, on the outer surface of the outer cap 4, there may also be provided a clip 44 similar to the clip 44 employed in the second embodiment.

While there has been described in connection with the preferred embodiments of the present invention, it will be obvious to those skilled in the art that various combination of the embodiments or changes and modification may be made therein without departing from the present invention, and it is aimed, therefore, to cover in the appended claim all such changes and modifications as fall within the true spirit and scope of the present invention.

What is claimed is:

1. A writing implement, comprising:

a cap comprising:

an inner cap having a closed front end portion and an opened rear end portion; and an outer cap fixed to an outer surface of the inner cap, at least a rear end of the outer cap being opened; and a writing implement main body for mounting the cap removably thereon, and including a barrel having a pen tip on a front end portion and an ink storing member disposed inside the barrel, wherein, when the cap is mounted on the pen tip side of the barrel, the inner cap seals the pen tip and an inner surface of the outer cap is fitted with an outer surface of the barrel, a backwardly projecting rear end shell portion is formed in the opened rear end portion of the inner cap, a non-threaded ring-shaped outward facing seal portion is formed in an outer peripheral surface of the rear end shell portion, a forwardly projecting front end shell portion is formed in the front end portion of the barrel, a non-threaded ring-shaped inward facing seal portion is formed in an inner peripheral surface of the front end shell portion, a removal preventive projection is formed in the front end portion of the barrel rearward of the non-threaded ring-shaped inward facing seal portion of the barrel, the removal preventive projection retaining the ink storing member within the barrel, and when the cap is mounted onto the pen tip side of the barrel, the outward facing seal portion closely contacts with the inward facing seal portion in a radial direction and a first fitting projection on an inner surface of the outer cap is moved over and fitted with a second fitting projection on an outer surface of the barrel by the first fitting projection moving out of engagement with the second fitting projection in an axial direction and back into engagement with the second fitting projection, wherein an axial-direction close contact sliding length between the ring-shaped outward facing seal portion and the ring-shaped inward facing seal portion is set in a range of 0.1 mm to 1.0 mm.

2. A writing implement, comprising:

a cap comprising:

an inner cap having a closed front end portion and an opened rear end portion; and an outer cap fixed to an outer surface of the inner cap, at least a rear end of the outer cap being opened; and a writing implement main body for mounting the cap removably thereon, and including a barrel having a pen tip on a front end portion and an ink storing member disposed inside the barrel, wherein, when the cap is mounted on the pen tip side of the barrel, the inner cap seals the pen tip and an inner surface of the outer cap is fitted with an outer surface of the barrel, a backwardly projecting rear end shell portion is formed in the-opened end portion of the inner cap, a non-threaded ring-shaped outward facing seal portion is formed in an outer peripheral surface of the rear end shell portion, a forwardly projecting front end shell portion is formed in the front end portion of the barrel, a non-threaded ring-shaped inward facing seal portion is formed in an inner peripheral surface of the front end shell portion, and a removal preventive projection is formed in the front end portion of the barrel rearward of the non-threaded ring-shaped inward facing seal portion of the barrel, the removal preventive projection retaining the ink storing member within the barrel, when the cap is mounted onto the pen tip side of the barrel, the outward facing seal portion closely contacts with the inward facing seal portion in the radial direction and a first fitting projection on an inner surface of the outer cap is moved over and fitted with a second fitting projection on an outer surface of the barrel by the first fitting projection moving out of engagement with the second fitting projection in an axial direction and back into engagement with the second fitting projection, a ventilating hole is formed in a side wall of the outer cap so as to penetrate therethrough, and when the outward facing seal portion and the inward facing seal portion are not in close contact with each other, an interior of the inner cap and an the exterior of the outer cap are allowed to communicate with each other through the ventilating hole, wherein an axial-direction close contact sliding length between the ring-shaped outward facing seal portion and the ring-shaped inward facing seal portion is set in a range of 0.1 mm to 1.0 mm.

3. A writing implement, comprising:

a cap comprising:

an inner cap having a closed front end portion and an opened rear end portion; and an outer cap fixed to an outer surface of the inner cap, having a closed front end portion and an opened rear end portion; and a writing implement main body for mounting the cap removably thereon, and including a barrel having a pen tip on a front end thereof and an ink storing member disposed inside the barrel, wherein when the cap is mounted on the pen tip side of the barrel, the inner cap seals the pen tip and an inner surface of the outer cap is fitted with an outer surface of the barrel, a backwardly projecting rear end shell portion is formed in the opened end portion of the inner cap, a non-threaded ring-shaped outward facing seal portion is formed in an outer peripheral surface of the rear end shell portion, a forwardly projecting front end shell portion is formed in the front end portion of the barrel, a non-threaded ring-shaped inward facing seal portion is formed in an inner peripheral surface of the front end shell portion, and a removal preventive projection is formed in the front end portion of the barrel rearward of the non-threaded ring-shaped inward facing seal portion of the barrel, the removal preventive projection retaining the ink storing member within the barrel, when the cap is mounted onto the pen tip side of the barrel, the outward facing seal portion closely contacts with the inward facing seal portion in a radial direction and a first fitting projection on an inner surface of the outer cap is moved over and fitted with a second fitting projection on an outer surface of the barrel by the first fitting projection moving out of engagement with the second fitting projection in an axial direction and back into engagement with the second fitting projection, a ventilating hole is formed in a side wall of the outer cap so as to penetrate therethrough, and when the outward facing seal portion and the inward facing seal portion are not in close contact with each other, an interior of the inner cap and an exterior of the outer cap are allowed to communicate with each other through the ventilating hole, wherein an axial-direction close contact sliding length between the ring-shaped outward facing seal portion and the ring-shaped inward facing seal portion is set in a range of 0.1 mm to 1.0 mm.

4. The writing implement as set forth in claim 2, wherein the ventilating hole is formed in the side wall of the outer cap at a position that is axially equal to a position of the rear end shell portion of the inner cap, or that is forward of the position of the rear end shell portion of the inner cap so as to penetrate therethrough.

5. The writing implement as set forth in claim 1, wherein a restrict wall portion, with which the front end of the front end shell portion of the barrel contacts, is formed in the outer surface of the inner cap existing forwardly of the outward facing seal portion.

6. The writing implement as set forth in claim 1, wherein a restrict wall portion, with which the rear end of the rear end shell portion of the inner cap contacts, is formed in the inner surface of the barrel existing backwardly of the inward facing seal portion.

7. The writing implement as set forth in claim 1, wherein the writing implement main body comprises:

the barrel accommodating the ink storing member in the front portion thereof, and an ink tank formed backwardly of the ink storing member within the barrel, wherein the ink storing member stores provisionally surplus ink corresponding to an increase in internal pressure of the ink tank.

8. The writing implement as set forth in claim 5, wherein a portion of the rear end shell portion existing backwardly of the restrict wall portion is formed thin in thickness and cylindrical in shape.

9. The writing implement as set forth in claim 6, wherein the portion of the front end shell portion existing forwardly of the restrict wall portion is formed thin in thickness and cylindrical in shape.

10. The writing implement as set forth in claim 2, wherein a total opening areas of the ventilating hole is 0.5 $mm^2$ or more.

11. The writing implement as set forth in claim 1, wherein the inner cap further comprises an outward facing projection, wherein the outer cap further comprises an inward facing projection, and wherein an outer surface of the top wall of the inner cap contacts with an inner surface of the top wall of the outer cap, and the inward facing projection engages the outward facing projection, which secures the inner cap and the outer cap together.

12. The writing implement as set forth in claim 11, wherein a ventilating groove is formed in the outward facing projection, which provides clearance for air flow.

13. The writing implement as set forth in claim 4, wherein the ventilation hole is formed in the side wall of the outer cap at a position along the axial direction that substantially coincides with the position along the axial direction of the rear end shell portion of the inner cap.

14. The writing implement as set forth in claim 5, wherein the restrict wall is step-shaped.

15. The writing implement as set forth in claim 6, wherein the restrict wall is step-shaped.

16. The writing implement as set forth in claim 12, wherein an interior space of the inner cap is in communication with an exterior of the inner cap through the ventilation groove.

17. The writing implement as set forth in claim 12, wherein the ventilation groove extends in an axial direction of the inner cap.

* * * * *